United States Patent [19]

Itagaki

[11] 4,030,564

[45] June 21, 1977

[54] LOUD SPEAKER WITH STABLE DAMPING

[75] Inventor: Tadasi Itagaki, Tokorozawa, Japan

[73] Assignees: Pioneer Electronic Corporation, Tokyo; Tokorozawa Electronic Corporation, Tokorozawa, both of Japan

[22] Filed: Oct. 30, 1975

[21] Appl. No.: 627,415

Related U.S. Application Data

[63] Continuation-in-part of Ser. No. 481,411, June 20, 1974, abandoned.

[30] Foreign Application Priority Data

June 28, 1973 Japan ..... 48-76021[U]

[52] U.S. Cl. ..... 181/166; 179/180; 181/158; 181/160

[51] Int. Cl.[2] ..... G10K 13/00; H04R 7/00; H04R 1/28

[58] Field of Search ..... 181/166, 160, 158, 156; 179/180, 115.5 R

[56] References Cited

UNITED STATES PATENTS

| | | | |
|---|---|---|---|
| 2,249,161 | 7/1941 | Mott | 181/160 |
| 2,540,498 | 2/1951 | Tallman | 181/158 |
| 2,761,912 | 9/1956 | Touger et al. | 181/166 |
| 2,763,730 | 9/1956 | Paull et al. | 181/158 |
| 3,261,927 | 7/1966 | Paul et al. | 181/160 |
| 3,418,437 | 12/1968 | Hoffmann | 181/160 |

FOREIGN PATENTS OR APPLICATIONS

| | | | |
|---|---|---|---|
| 1,027,951 | 5/1966 | United Kingdom | 179/180 |

*Primary Examiner*—Stephen J. Tomsky
*Attorney, Agent, or Firm*—Sughrue, Rothwell, Mion, Zinn & Macpeak

[57] ABSTRACT

A loud speaker having air communicating holes within the rear portion of the frame and facing the diaphragm is provided with regularly woven wire gauze formed of warp and weft wire threads of different diameter, which gauze covers the communicating holes to obtain a stable vibration damping effect.

5 Claims, 7 Drawing Figures

FIG. 1
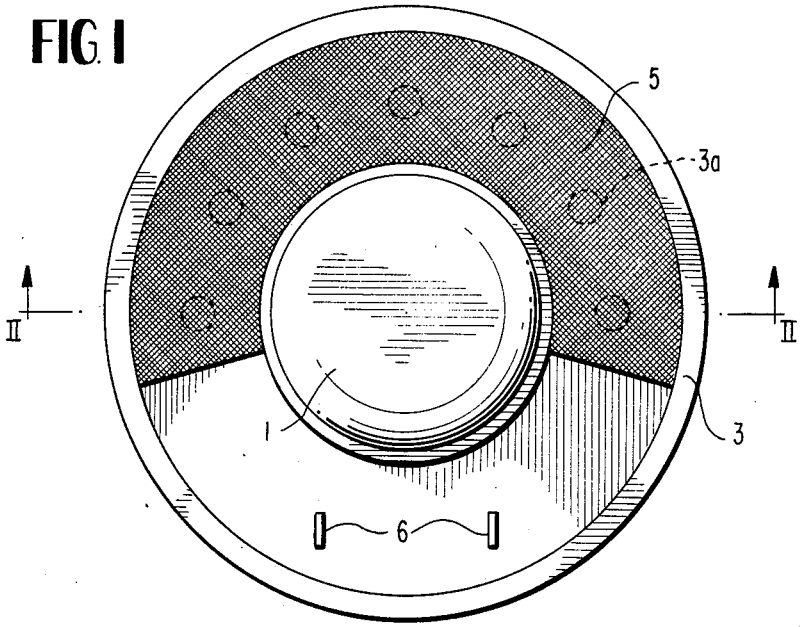
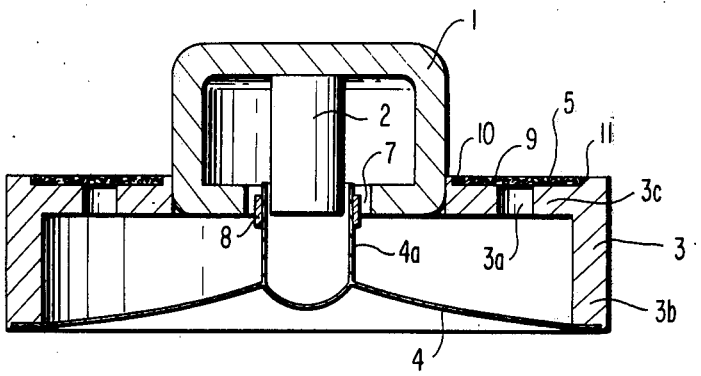
FIG. 2

FIG. 3
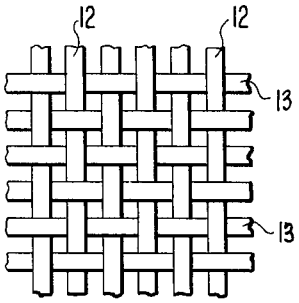
FIG. 4
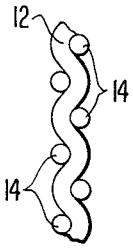
FIG. 5
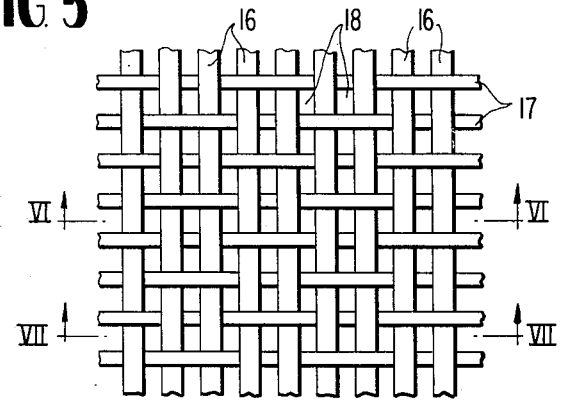
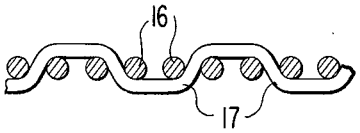
FIG. 6
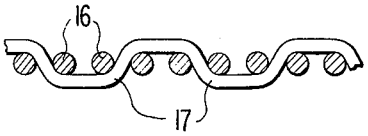
FIG. 7

LOUD SPEAKER WITH STABLE DAMPING

RELATED APPLICATIONS

This application is a continuation-in-part application of application Ser. No. 481,411 filed June 20, 1974, for IMPROVED LOUD SPEAKER WITH STABLE DAMPING, and now abandoned.

BACKGROUND OF THE INVENTION

1. Field of the Invention

This invention relates to loud speakers, and more particularly, to those loud speakers in which vibration damping of the vibrating plate is employed.

2. Description of the Prior Art

In loud speakers, especially in dynamic speakers used in head phones, the resonance frequency of the vibrating plate is high, so that insufficient damping is liable to occur when electromagnetic damping means are employed. For this reason, a damping material such as felt is often mounted on the rear portion of the vibrating plate to obtain uniform reproduction characteristics.

However, since the felt is produced by gathering vegetable fibers, animal hairs, synthetic resin fibers or the like and by compacting these materials closely and entwining them irregularly, the density of the material varies by application of pressure, and the density also depends greatly upon external parameters such as temperature, humidity, etc.

Thus, by the employment of felt as a damping material, stable damping is impossible because of the variation of permeability and by the effect of various parameters acting on the material making up the felt.

Accordingly, it is necessary therefore to obtain uniform sound reproduction characteristics by way of the means or arrangement for mounting the damping material rather than from the material itself. Since the permeability of the material is non-uniform, the damping member must be relatively large in size.

SUMMARY OF THE INVENTION

The present invention resides in providing a loud speaker in which a metal wire gauze is substituted for the felt which has heretofore been used as the damping material to obtain a stable damping effect for the vibrating plate.

Specifically, where the magnet frame supports the periphery of a vibrating plate and has air communicating holes formed behind the vibrating plate and within the frame, a metal wire gauze is fitted to the rear portion of the frame to cover the air communicating holes.

The wire gauze is of regularly woven form with the weft preferably of smaller diameter than the warp and woven to the warp such that the warp is essentially linear and the weft is serpentine to reduce the gap between the wefts and improve the damping effect of the acoustical resistance formed by the wire gauze.

BRIEF DESCRIPTION OF THE DRAWINGS

FIG. 1 is a rear view of a head phone speaker employing the present invention.

FIG. 2 is a cross sectional view of the speaker of FIG. 1 taken about line II — II.

FIG. 3 is a plan view of a conventional woven "plain fabric".

FIG. 4 is an end view of the fabric shown in FIG. 3.

FIG. 5 is a plan view of regularly woven metal wire gauze forming the damping material of the improved speaker of FIGS. 1 and 2.

FIG. 6 is a sectional view of the metal wire gauze of FIG. 5 taken about line VI — VI.

FIG. 7 is a sectional view of the metal wire gauze of FIG. 5 taken about line VII — VII.

DESCRIPTION OF THE PREFERRED EMBODIMENT

Referring to the drawings, an example of the improved loud speaker of the present invention having stable damping of the vibrating plate is illustrated as having a yoke 1 which supports at its center a magnet 2 in such fashion as to concentrically surround the magnet. Extending radially outward and about the yoke 1, is an annular frame 3 which includes an axially extending flange portion **3*b* which extends axially forward of the plane defined by the front edge of the yoke 1 and the front end of the magnet 2. A vibrating plate 4 of conventional construction in disc form is fixed at its periphery to the forward end of the flange 3*b* of frame 3 and includes a cylindrical portion 4*a* at its center which is concentrically positioned within air gap 7 formed between the yoke 1 and magnet 2, the cylindrical portion 4*a* of the vibrating plate carrying a speaker coil 8 in conventional fashion which is connected electrically to a circuit external of the speaker by way of terminals 6, FIG. 1. Under energization of coil 8, the diaphragm or vibrating plate 4 vibrates with coil 8 moving axially within air gap 7**.

With respect to the present invention, air communicating holes of given diameter are formed within frame 3 to the rear of the vibrating plate 4 and are spaced circumferentially about that portion of frame 3. As shown in FIG. 1, the holes **3*a* extend through an arc, in this case somewhat in excess of 180°. The number and location of the air communicating holes may vary. The essence of the present invention is the provision of damping material in the form of a metal wire gauze 5 which in this case takes the form of an annular strip which is fitted within the rear wall of frame 3 so as to cover the air communicating holes 3*a*. In this respect, the rear wall 3*c* of frame 3 is recessed as at 9, a depth on the order of the thickness of the annular strip of metal wire gauze 5, so that the inner and outer peripheral edges of the annular metal wire gauze strip contact the inner and outer sidewalls 10 and 11 of recess 9. If the gauze strip is slightly wider than recess 9, the gauze 5 may be force fitted into the recess and this eliminates the necessity of adhesive for fixing gauze 5 to the rear of frame 3. Preferably, by cutting the annular strip of metal wire gauze 5 to a width slightly in excess to the width of the recess 9, the outer and inner peripheral edges of the wire gauze is force fitted into contact with the sidewalls 10 and 11 of the recess 9, so that the wire gauze frictionally engages the frame 3. This elminates the necessity for using adhesive which was normally employed previously for fixing the felt vibration damping material to the back of the diaphragm or vibrating plate 4**.

In order to sufficiently reduce the penetration of air through the mesh of the metal wire gauze, stainless steel wire is employed as the material, and the gauze is preferably woven regularly with a warp of 0.07 mm and a weft of 0.04 mm.

The improvement in the damping characteristics of the metal wire gauze of the present invention may be best appreciated by reference to a conventional woven plain fabric, wherein the warp and weft fibers are essentially of the same diameter and are interleaved at each crossing point, that is, the warp fibers 12 overlay a weft fiber of filament 13 and then underlie the next adjacent weft fiber or filament 13, the weft fibers or filaments 13 doing the same with respect to the warp fibers or filaments 12. The effect of this, as may be seen in FIG. 4, particularly where the fibers or filaments are of the same diameter, is to distort in serpentine fashion both the weft and the warp fibers and at the same time produce gaps therebetween as at 14 which are comparatively large. In contrast, in the present invention, as seen in FIGS. 5, 6 and 7, the stainless steel warp wires 16 which preferably are of larger diameters than the stainless steel weft wires 17 and in the example are of 0.07 mm and 0.04 mm diameter respectively, are woven into regular form known was a Japanese mat fabric, the weft wires overlapping and underlapping pairs of adjacent warp wires and at the same time due to the fact that the weft stainless steel wires are of smaller diameter, they take serpentine form while the warp wires, being of larger diameter and formed of similar stainless steel wire remain essentially straight or linear. The wrap wires overlie and underlie adjacent weft wires at each contact point. The net effect is in contrast to the plain fabric weaving of conventional metal wire gauze where both warp and weft threads of similar diameter are woven together at each crossing point. As seen in FIG. 4, both the warp and the weft threads, which may be formed of stainless steel wire, as result of weaving are deformed into serpentine fashion having regularly occurring crests and troughs and it is difficult to narrow the gap 14 between threads. Accordingly, when such metal gauze is used as acoustical resistance, a full dampening effect cannot be obtained.

However, in contrast, the present invention provides a woven fabric whose warp threads or wires are maintained in linear form while the weft being of smaller diameter is deformed into serpentine form having the crest and trough and the gap between the wefts is narrowed, with the result that a highly desirable damping effect is obtained when the gauze is used as an acoustical resistance in the manner of the present invention.

Further, since the weft wires are of smaller diameter than the warp wires, the weft is easily woven to the warp.

The present invention may be contrasted significantly from the prior use of felt as the vibration damping material, since when the gauze is substituted therefor, the permeability is not affected by pressure, ambient temperature, humidity, etc., the damping characteristic is thus stabilized, and there are additional advantages.

Since the density of the metal gauze does not vary by external factors such as the environment of use, the air permeability is not affected. Secondly, since the density remains uniform over the wire gauze, the desired damping effect is obtained by use of a smaller area of the material in terms of that necessary when using felt. This is because to the contrary in the case of felt, a large area is required due to its non-uniform density. Thirdly, since the gauze is made of metal, there is no deterioration with time or variation in dimension, and no change occurs in the material in terms of its working or handling capability. Fourthly, the fitting is carried out, if necessary, as mentioned previously, without adhesive, so that the fixing of the damping material to the loud speaker is extremely simple and easy to achieve. Fifthly, during the fixing or fitting operation of the felt as the damping material to the loud speaker, fluctuation in damping is unavoidably produced in each of the loud speakers during fit, and therefore, adjustments must be made subsequent to fitting for each speaker manufactured. However, where metal wire gauze is employed, since the characteristics are uniform, there is no need for adjusting the amount of damping, etc., subsequent to fixing the wire gauze to the frame.

While the invention has been particularly shown and described with reference to a preferred embodiment thereof, it will be understood by those skilled in the art that various changes in form and details may be made therein without departing from the spirit and scope of the invention.

What is claimed is:

1. In a loud speaker of the type having an annular frame concentrically surrounding a central magnet and supporting said magnet by means of transversely extending wall portion fixed to one edge of the annular frame and including a central yoke upon which said magnet is mounted and having a diaphragm fixed at its periphery to the other edge of said annular frame remote from said wall portion, the improvement comprising: air communication holes within the wall portion of said frame facing said diaphragm, and a regularly woven metal wire gauze covering the air communication holes to provide stable vibration damping to the loud speaker diaphragm, and wherein said air communication holes extend through the wall portion of the frame in a circumferentially spaced array, the surface of said wall portion of said frame is recessed annularly and said metal wire gauze comprises a unitary annular strip fixed to the surface of the wall portion remote from said diaphragm and fixedly carried within said recess and overlies all of the holes.

2. The loud speaker as claimed in claim 1, wherein said annular metal wire gauze strip is slightly wider than the width of said annular recess and said metal wire gauze strip is force fitted into said recess and frictionally restrained thereby.

3. A loud speaker as claimed in claim 1 wherein said metal wire gauze comprises wires whose weft and warp diameters are substantially different such that the larger diameter wires remain linear and the smaller diameter wires curve about said larger diameter wires in serpentine fashion to minimize the gaps therebetween and improve the damping characteristics of the wire gauze.

4. The loud speaker as claimed in claim 3, wherein said warp and weft wires comprise stainless steel wires with the warp wires being approximately twice the diameter of the weft wires.

5. The loud speaker as claimed in claim 4, wherein said warp wires are 0.07 mm in diameter and said weft wires are 0.04 mm in diameter.

* * * * *